US007267138B2

(12) United States Patent
Paradis

(10) Patent No.: US 7,267,138 B2
(45) Date of Patent: Sep. 11, 2007

(54) MANIFOLD CABINET

(76) Inventor: Jeffrey S Paradis, 41 Poor Farm Rd., Nottingham, NH (US) 03290

( * ) Notice: Subject to any disclaimer, the term of this patent is extended or adjusted under 35 U.S.C. 154(b) by 247 days.

(21) Appl. No.: 10/906,233

(22) Filed: Feb. 10, 2005

(65) Prior Publication Data

US 2006/0175943 A1 Aug. 10, 2006

(51) Int. Cl.
*F16L 35/00* (2006.01)

(52) U.S. Cl. ..... 137/377; 312/223.1; 312/265.6; 137/374

(58) Field of Classification Search ..... 137/374, 137/377, 343, 884, 561 A, 360; 312/213, 312/229, 242, 245, 265.6, 223.1, 223.6; 220/3.2, 220/3.3, 3.8, 3.9, 3.92, 3.94, 324, 476, 501, 220/524, 529, 553; 361/826; 174/481, 504, 174/505

See application file for complete search history.

(56) References Cited

U.S. PATENT DOCUMENTS 459,523 A * 9/1891 Keller et al. ..... 174/59
488,198 A * 12/1892 Hart ..... 174/50
1,302,137 A * 4/1919 Cook ..... 174/60
1,396,434 A * 11/1921 Horton ..... 220/524
1,422,910 A * 7/1922 Young et al. ..... 174/60
2,185,032 A * 12/1939 Marsh ..... 220/3.2
2,725,894 A * 12/1955 Spartaco ..... 137/360
2,779,812 A * 1/1957 Rowe ..... 174/50
3,088,560 A * 5/1963 Preuss ..... 312/265.6
3,136,442 A * 6/1964 Massey ..... 220/3.8
3,236,545 A * 2/1966 Parkes et al. ..... 285/215
3,470,901 A 10/1969 Nisley
3,618,804 A * 11/1971 Krause ..... 220/3.8
3,983,311 A * 9/1976 Brumfield et al. ..... 174/50
3,996,959 A * 12/1976 Caruth ..... 137/360
4,032,821 A * 6/1977 Keiser ..... 361/622
4,432,392 A * 2/1984 Paley ..... 137/883
4,502,609 A * 3/1985 Christatos ..... 220/3.8
4,683,517 A * 7/1987 Yazvac ..... 361/647
5,238,017 A * 8/1993 Andersson et al. ..... 137/15.17
5,253,670 A 10/1993 Perrott
5,381,902 A 1/1995 Dumser et al.
5,555,907 A 9/1996 Philipp
5,573,321 A * 11/1996 Bell, Jr. ..... 312/242
5,574,251 A * 11/1996 Sevier ..... 174/50
5,823,646 A * 10/1998 Arizpe et al. ..... 312/324
6,062,254 A 5/2000 Brady et al.
6,085,780 A * 7/2000 Morris ..... 137/377
6,199,580 B1 3/2001 Morris
6,250,727 B1 * 6/2001 Kan et al. ..... 312/223.2
6,382,744 B1 * 5/2002 Xiao ..... 312/223.2
D466,087 S * 11/2002 Cuny et al. ..... D13/152
6,642,445 B1 * 11/2003 Lalancette ..... 174/507

* cited by examiner

*Primary Examiner*—Janet M. Wilkens
*Assistant Examiner*—Mart K Kuhn
(74) *Attorney, Agent, or Firm*—Robert R Deleault, Esq.; Mesmer & Deleault, PLLC

(57) ABSTRACT

A manifold cabinet includes an enclosure having a back wall, a top wall, a pair of side walls, at least two partition walls, a center opening and at least two outside edge openings. The partition walls have a plurality of openings and are attached within the enclosure forming a larger central chamber sized to receive a manifold and two side chambers. The center opening provides access to the larger central chamber and each of the two outside edge openings provide access to one of the two side chambers.

10 Claims, 5 Drawing Sheets

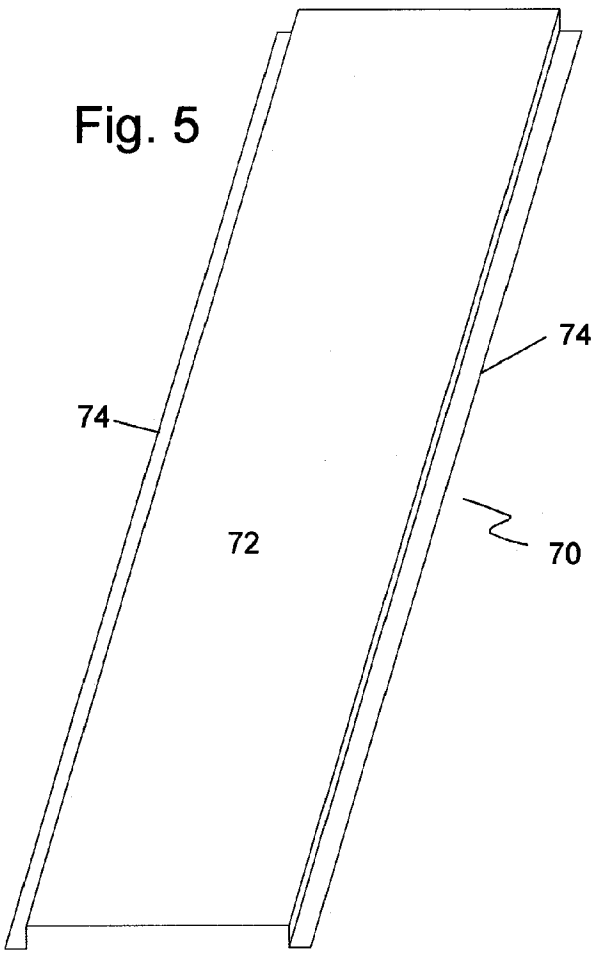
Fig. 5
Fig. 4
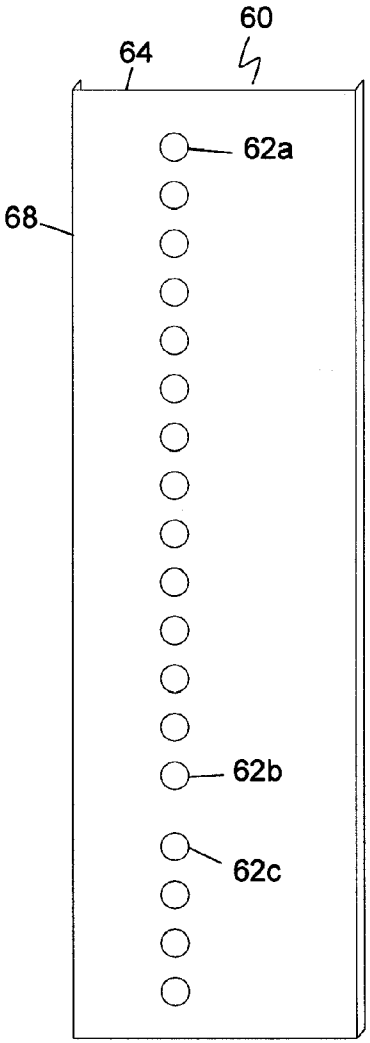

MANIFOLD CABINET

BACKGROUND OF THE INVENTION

1. Field of the Invention

The present invention relates generally to manifolds. Particularly, the present invention relates to a housing or cabinet for receiving and mounting a manifold.

2. Description of the Prior Art

Manifolds are devices used to control the delivery of fluids. Typically, manifolds can be used to provide water or heat to a building structure. Manifolds divide a main supply source into multiple branches from a central location. Typically, manifolds have a main body that contains valves to control the flow of a liquid. Manifolds also have an input port that is fed from a main supply source through a tubing connection. Additionally, manifolds have multiple output ports with tubing connections that each feeds a single outlet, such as a faucet.

Currently, manifolds are mounted on a building wall between the wall studs and to drill holes into the studs of the building to accommodate the outlet tubing. The number of output tubing connections on the manifold determine the number of holes needed in the studs. Typically, twelve or more holes are drilled in vertical alignment adjacent to each other in two adjacent studs. The spacing of the drilled holes approximate the spacing between the outlet tubing connections on the manifold. The holes in the studs provide an alignment function that allows the outlet tubing to connect to the outlet connections on the manifold while minimizing any lateral pressure on the connection that could cause leakage. A disadvantage with this approach is that the stud walls are structurally weakened by this series of closely-spaced holes placed in two adjacent studs. The greater number of holes required to accommodate the manifold outlet connections, the weaker the stud wall becomes structurally. Another disadvantage is that mounting the manifolds in this manner is time consuming. Each hole in each stud must be marked and drilled before the manifold can be installed.

Manifold housings have been used as protective structure for manifolds and their associated tubing components. These housings have also been used to protect the manifolds from outside environment or to contain the unit contents if, for example, leakage were to occur. These housings are typically made from a plastic or thermally insulating material. Manifold housings are also commonly attached to a wall. Several of these devices are disclosed.

U.S. Pat. No. 5,381,902 (1995, Dumser et al.) discloses a unit for supplying a circuit of a heating or cooling supply system which are required for conveying a medium and for regulating and monitoring the medium. The units are arranged at parallel pipelines for forward and return flows so as to be combined in an installation-ready structural component group in a housing of thermal insulating plastic. The housing is divided into a lower and an upper shell. The lower shell is provided with a component for direct fastening to a wall. The upper shell is provided with openings that allow the parts of the unit essential for operation to penetrate. Particularly, a lock-seam connection is used between the two shells. The strength and thickness of the material is selected so that the housing can be used as a protective transportation packing for the structural component group and as a thermal insulating sheathing after assembly.

A disadvantage of the Dumser device is that only one component group circuit system can be used in each unit. This requires a series of units to be used if multiple systems are to be employed. Another disadvantage is that the system requires exposure of all valves and connection components if repair or other access is needed beyond end-user operational control.

U.S. Pat. No. 6,062,254 (2000, Brady et al.) discloses a manifold protective valve enclosure which has a bottom portion and a valve mounting subbase portion disposed on the bottom portion. A portion of the perimeter of the bottom portion is surrounded by side walls and a cover is provided over the side walls to completely enclose and protect the subbase and the valve. A portion of at least one side wall forms a side of the subbase, or integral conduit members can provide fluid communication between the side of the subbase and the side wall. The subbase can have the requisite ports configured to mate with the ports in the valve and can further have a receptacle for an electrical connector on the valve. Passageways through the side walls provide fluid communication between external connections. The subbase and access holes through the side walls can provide access between an external electrical source and the receptacle on the valve subbase. All external plumbing and wiring for the valve is directly connected to the manifold protective valve enclosure instead of the valve.

A disadvantage of the Brady device is that a known valve configuration is required for proper mating with the subbase. The subbase is not adaptable to different manifold configurations.

U.S. Pat. No. 6,085,780 (2000, Morris) discloses a manifold box for valves controlling the flow of potentially hazardous liquids. Particularly, this is a rotationally cast sealed plastic box enclosing the valves and allowing any leaking liquid to drain from the box through a drain tube at the bottom of the box. Attachment engaging "tee-nuts" are cast in place within the walls of the box and the fittings for tubing connections are spin welded to the walls of the box. The box has a front access opening sealingly closed by a hinged plastic cover panel.

A disadvantage of the Morris device is that the fittings for the tubing connections are welded to the walls. This does not allow for interchangeability of the tubing configuration.

Therefore, what is needed is a manifold housing that is made for use with multiple manifold units in a self-contained, organized structure. What is further needed is a housing that can be adapted for use with any manifold configuration.

SUMMARY OF THE INVENTION

It is an object of the present invention to provide a cabinet for use with a manifold or series of manifolds. It is another object of the present invention to provide a cabinet for varied manifold configurations. It is a further object of the present invention to provide a cabinet for a manifold to limit the damage to the studs of a building structure. It is yet another object of the present invention to provide a cabinet for manifolds to reduce the time required to install a fluid manifold in a building structure.

The present invention achieves these and other objectives by providing a manifold cabinet that holds one or more manifolds and their associated inlet and outlet tubing. The manifold cabinet of the present invention includes an enclosure that has a back wall, a top wall, a bottom wall, a pair of side walls, at least two partitions forming a larger central chamber and two side chambers, a central opening that provides access to the larger central chamber, and at least two outside edge openings that provide access to the two side chambers. The present invention may also include optional covers for the two side chambers.

The top wall, bottom wall, and side walls may include an optional lip around the inside perimeter of the enclosure. The top wall of the enclosure preferably has three openings—a center opening and two outside edge openings. The top wall also has an optional pair of holding members attached to the front side edge of the top wall substantially aligned with each of the two side chambers. These holding members form one half of a locking mechanism with the holding members on the optional covers.

The partition walls have a plurality of openings. The openings allow for fluid communication between each of the side chambers with the central chamber. These openings align with the manifold output ports such that the tubing running from the manifold to the outlet is supported. This support lessens the lateral forces acting on the outlet tubing connection, which lessens the chance of leakage.

An optional mounting plate can be affixed to the back wall of the enclosure in the central chamber. The optional mounting plate provides a means for attaching the manifolds without having the attaching hardware penetrate through the back wall of the enclosure. As previously mentioned, optional covers can enclose the two side chambers. Each cover can have two cover retaining members, a top cover retaining member and a bottom cover retaining member, located on opposing ends of the inside surface of the cover. The top cover retaining member slidingly engages with a mating cover holding member along the front edge of the top wall while the bottom cover retaining member slidingly engages with a bottom wall lip An optional fastener can be attached to the back of the back wall in order to mount the enclosure on a wall.

In a preferred embodiment, the top wall has formed therein the center opening and the two outside edge openings. Instead of forming the openings into the top wall, it is also an option to have no top wall but to provide a top support connected between the side walls. The placement of two partitions in the enclosure would create the center opening for the larger central chamber and the two outside edge openings for the two side chambers. It should also be understood that the central opening and the two outside edge openings may be formed by simply removing a portion of the wall in which it is formed such that the wall has two wall portions that are bent and connected to a wall support that spans between the corners of the manifold cabinet, or uses the partitions to secure the two wall portions.

Manifolds can be fastened to the inside of the back wall, or optionally to a mounting plate, in the central chamber of the enclosure. The main supply line of the water or heat utility, which is to be controlled by the manifold, runs from the main supply source directly to the manifold through the center opening in the top wall of the enclosure. The medium to be conveyed can then run out from one or more of the manifold output tubing connections. Each tubing connection runs from the manifold, through one of the openings in the partition walls and out of the cabinet through one of the outside edge openings of the enclosure to the appropriate outlet. In summary, the manifold is housed in the central chamber and the associated tubing components are housed in the side chambers with connection to the outlet ports of the manifold through the partitions.

The optional covers can be mounted over the side chambers to hide the tubing. Additionally, optional finger holes or other cover handling structure can be placed in or on the cover for ease in attaching and removing the covers. The central chamber containing the manifold remains uncovered and accessible for valve manipulation.

Although the manifold cabinet of the present invention can be assembled from individual wall, partition and back components, it is more economical to form the enclosure from sheet material. The material may be wood, plastic, metal, and/or composites. The preferred material is 26-gauge sheet metal for ease of forming the enclosure, openings, partitions, and covers of the manifold cabinet. A rectangularly-shaped sheet is used to form the enclosure. A portion of each corner of the sheet is removed. The center opening and the two outside edge openings are preferably formed along one side of the sheet by stamping or punching the openings. A portion along each side of the sheet is bent to form a lip approximately 0.75 inches wide. Next, another portion along each side of the sheet is bent forming the top wall, bottom wall and the two side walls such that the ends of each wall meet to form a corner of the enclosure. The corners are secured preferably by welding, but may be connected using any of the known methods for joining similar components.

The two partition walls are then formed from another sheet of material. The partition walls will typically have a length substantially equal to the distance between two opposing walls of the enclosure and a width substantially equal to the depth of the enclosure. A plurality of openings is stamped/punched along the length of each partition wall spaced from a front edge of the partition wall such that the openings will substantially align with the particular manifold used. The openings will also be spaced from each other to substantially align with each of the outlet ports on the manifold used. The two partition walls are secured within the enclosure using methods known by those of ordinary skill in the respective arts. The two partition walls are positioned preferably to form a larger central chamber and two side chambers in the enclosure.

Where covers are to be used with the cabinet to enclose the two side chambers, a means for removably securing the covers to the enclosure is incorporated. The means for removably securing the covers may be include hinges, snaps, twist-post locks, levers, etc. The preferred means is to slidingly engage the covers with the enclosure. This is best accomplished by including a cover holding member along the top wall edge that has an upwardly bent edge. The inside top edge of the cover has a mating top cover retaining member that has a downwardly bent edge. The top cover retaining member slidingly engages with the cover holding member to interlock the pieces together. The cover also has a bottom cover retaining member formed adjacent the bottom edge of the cover. The bottom cover retaining member slidingly engages with a lip formed along the outside bottom edge of the enclosure.

BRIEF DESCRIPTION OF THE DRAWINGS

FIG. 4 is a perspective view of the partition wall of the present invention.

FIG. 5 is a perspective view of the mounting plate of the present invention.

DETAILED DESCRIPTION OF THE PREFERRED EMBODIMENT

Figure 1:
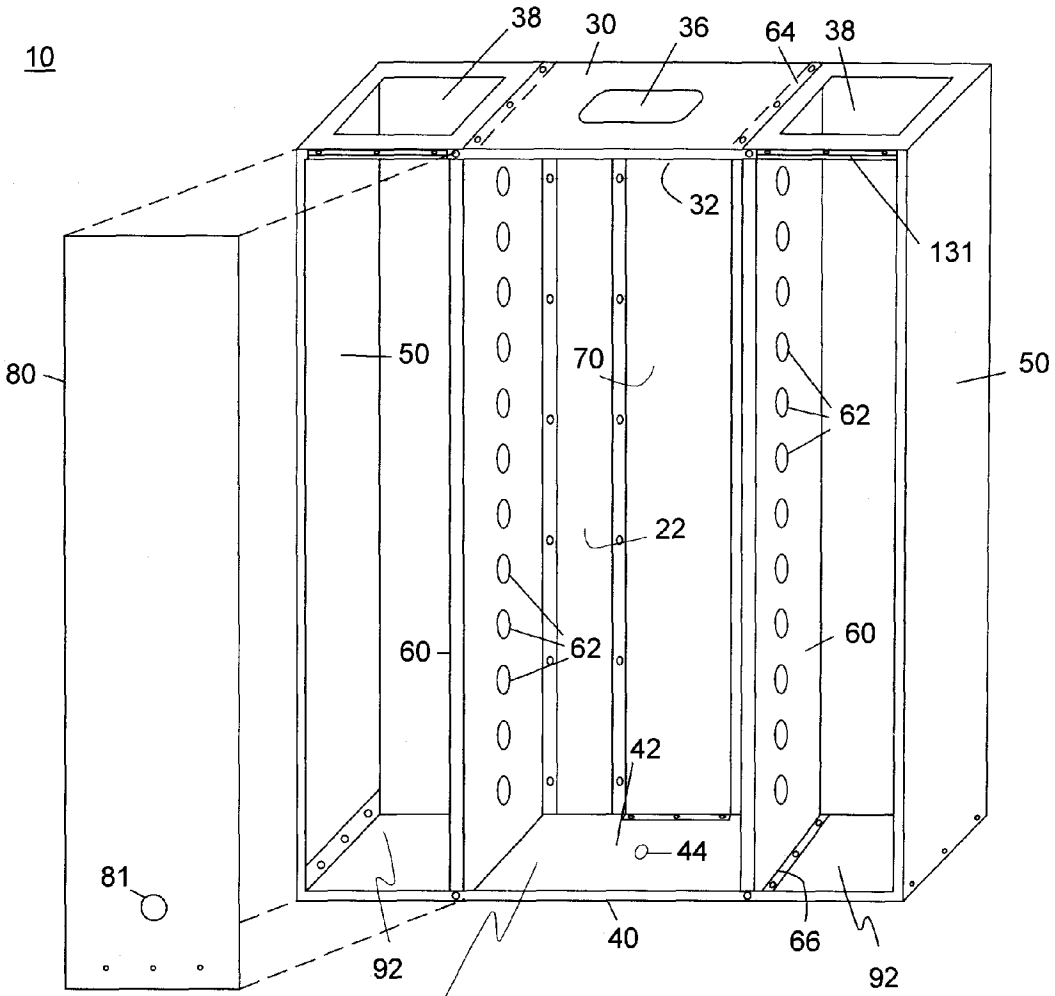
FIG. 1 is a perspective view of one embodiment of the manifold cabinet of the present invention.

The preferred embodiment(s) of the present invention is illustrated in FIGS. 1-8. FIG. 1 illustrates a perspective view of a manifold cabinet 10 of the present invention. Manifold cabinet 10 includes an enclosure 20, a pair of partition walls 60, and an optional manifold mounting plate 70. Enclosure 20 includes a back wall 22, a top wall 30, a bottom wall 40, and a pair of side walls 50. Partition walls 60 create a central chamber 90 and two side chambers 92 within enclosure 20. Central chamber 90 is typically larger than either side chambers 92 and is sized to receive one or more manifolds. An example of a typical manifold that can be used with the present invention are the Vanguard Manabloc manifolds available from Vanguard Piping Systems, Inc. of McPherson, Kans.

Optional manifold mounting plate 70 is secured to back wall 22 of enclosure 20 and is preferably used when the installer does not want the manifold mounting screws to protrude through back wall 22. In the embodiment in FIG. 1, top wall 30 includes a manifold feed opening 36 and at least one manifold outlet tubing opening 38. Partition walls 60 have a plurality of openings 62 and have a partition wall top end 64 (not shown) connected to an inside surface 32 (not shown) of top wall 30 and a partition wall bottom end 66 connected to an inside surface 42 of bottom wall 40. Manifold cabinet 10 may also include optional covers 80. Optional covers 80 are configured to enclose side chambers 92 and function only to hide the plurality of tubing that is connected to an installed manifold.

Figure 2A:
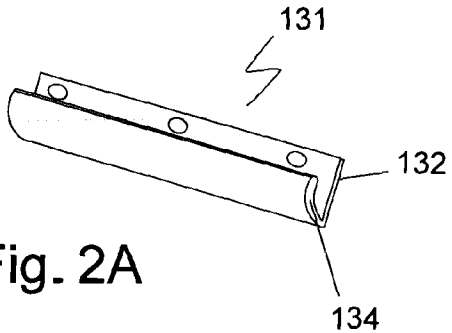
FIG. 2*a* is a perspective view of the cover holding member on the top wall of the enclosure of the present invention.
Figure 2:
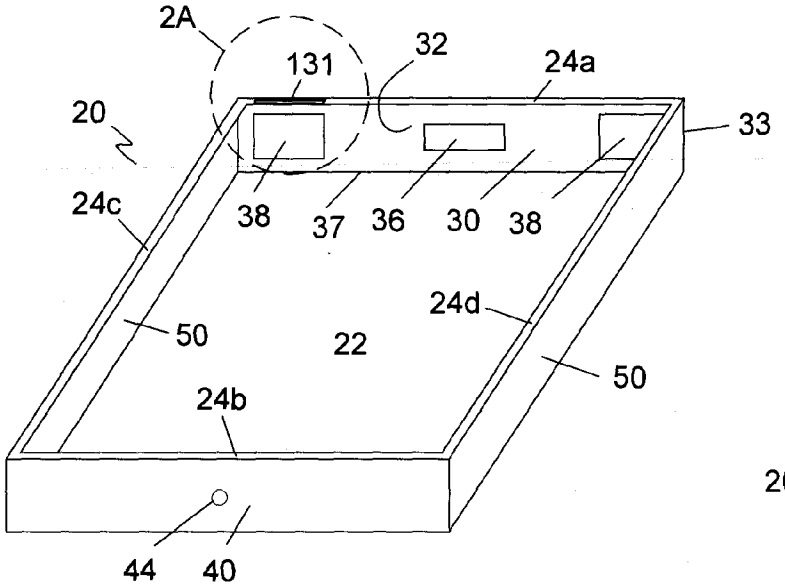
FIG. 2 is a perspective view of the present invention showing the enclosure without partition walls.

Turning now to FIG. 2, there is illustrated a perspective view of enclosure 20 in FIG. 1 without partition walls 60 installed. FIG. 2 shows enclosure 20 with back wall 22, top wall 30, bottom wall 40, and a pair of side walls 50. Enclosure 20 can be made of any suitable material such as, for example, metal, plastic or wood, or any combination of materials, but it is preferably made of 26-gauge galvanized sheet metal. Enclosure 20 can be sized to any dimension to accommodate the type of manifold used, but the preferred overall dimensions of enclosure 20 is about 38 inches long, about 30 inches wide, and about 3.8 inches deep. Top wall 30, bottom wall 40, and side walls 50, preferably each has a lip 24*a*, 24*b*, 24*c*, and 24*d* that extends perpendicularly from top wall 30, bottom wall 40, and side walls 50 around the perimeter of and towards the inside of enclosure 20. Lip 24 can be any size but is preferably about 0.75 inches wide. Optionally, when partition covers 80 are used, a cover holding member 131 is either attached or formed on lip 24*a* to coincide with chambers 92 and outside edge openings 38. Bottom wall may also have an optional drain opening 44. Cover holding member 131 may optionally be attached to a front edge 33 of top wall 30.

Top wall 30 may have any number of openings to accommodate different tubing sizes or shapes, but preferably has a center opening 36 and two outside edge openings 38. The two outside edge openings 38 can be of any shape or size in top wall 30 sufficient to allow the outlet tubing from an installed manifold to pass from chambers 92 to their respective connections outside of manifold cabinet 10. In the preferred embodiment, outside edge opening 38 are preferably located about 0.75 inches from the ends 33 of top wall 30 and is otherwise centered to form a rectangular opening about 2.75 inches by about 6 inches. The center opening 36 can be any shape or size or number to accommodate different supply lines, but is preferably centered on the top wall 30 about 1.125 inches from the back edge 37 of top wall 30 to form an oblong opening of about 3.5 inches by about 1.75 inches.

FIG. 2A is a perspective view of one of the optional cover holding members 131 of the present invention. Optional holding member 131 forms one half of an interlocking mechanism to secure the optional cover 80. Preferably, holding member 131 has a flat body portion 132 and a curved portion 134 that curves back towards flat body portion 132. Holding members 131 can be secured to lip 24*a*. Holding members 131 may optionally be made by bending additional material on lip 24*a* to form the interlocking mechanism. It is noted that although holding members 131 incorporate a sort of interlocking mechanism, holding members 131 may be any suitable attaching means for securing covers 80 over chambers 92. For example, holding members 131 may be a hinge, or a plurality of clips, snaps, swivel locks, etc. affixed to lip 24*a*.

Figure 3:
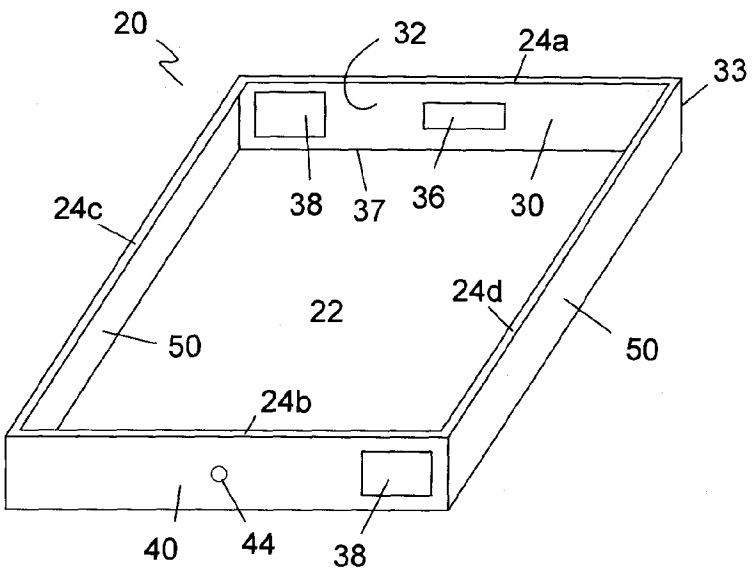
FIG. 3 is a perspective view of another embodiment of the enclosure of the present invention.

Turning now to FIG. 3, there is illustrated another embodiment of enclosure 20 of the present invention. For simplicity and clarity, like components are similarly numbered as those illustrated in FIG. 2. The structural features of this embodiment are the same as the embodiment shown in FIG. 2 except that one of the outside edge openings 38 has been re-positioned on bottom wall 40 of enclosure 20. In fact, center opening 36 or outside edge openings 38 can be removed from the top wall 30 and can be added to the bottom wall 40. It should be understood by those skilled in the art that placement of the center opening 36 and outside edge openings 38 are not critical to the functioning of the present invention except that center opening 36 must always provide access to the central chamber 90 and that outside edge openings 38 provide access to side chambers 92 in order to accommodate the position of the supply source or outlet lines, but is preferably a mirror image positioning from that of the top wall 30. Further, it should also be understood that the enclosure 20 can be rotated 90° such that the inlet supply source and outlet tubing lines may enter and exit from the right or left of manifold cabinet 10.

FIG. 4 is a perspective view of a partition wall of the present invention. FIG. 4 shows partition wall 60 with a plurality of openings 62. Openings 62 in the partition wall 60 can be of any size or shape to accommodate the size and shape of the tubing that will be used with the manifold that will be installed in central chamber 90. Preferably, the shape is substantially circular and the preferred size of the openings 62 is about 0.875 inches in diameter. The openings 62 can also vary in number depending on the number of outputs on the associated manifold, but the preferred number of openings 62 in the partition wall 60 is eighteen in order to accommodate one or more manifolds. The openings 62 can also be placed in any position and distance in the partition wall 60 depending on the configuration of the manifold such that the output tubing is aligned with the outlet ports on the manifold. The preferred placement when using the Vanguard Manabloc includes a topmost opening 62*a* preferably placed at a distance of about 1.75 inches from the front edge 68 of partition wall 60 to the center of the opening 62*a*. The topmost opening 62*a* is also preferably placed about 4.375 inches from the top edge 64 of partition wall 60. Openings 62 are preferably spaced 1.68 inches apart, except for openings 62*b-c* which are preferably spaced about 2.43 inches apart to accommodate the specific configuration of the Vanguard Manabloc. It should be understood that the openings 62 in partition wall 60 are positioned and spaced to accommodate particular manifolds thus partition walls 60 may come in several configurations designed specifically to match manifold manufacturer specifications.

Now turning to FIG. 5, there is illustrated a perspective view of the optional manifold mounting plate. FIG. 5 shows mounting plate 70 which can be made of any material capable of bearing weight, such as metal, wood or plastic, but preferably mounting plate 70 is made of galvanized sheet metal. Mounting plate 70 preferably has a central stepped portion 72 offset from side portions 74. Stepped portion 72 can be any height but is typically dependent on the manifold mounting hardware used to mount the manifold to mounting plate 70. Stepped portion 72 is preferably offset from side portions 74 by about 0.25 inches. Stepped portion 72 of mounting plate 70 can also be any size to accommodate the size of the manifold but preferably measures about 5 inches wide and about 37.75 inches long. Side portions 74 can be any size to accommodate fastening to the back wall 22 of the enclosure 20 but is preferably about 0.75 inches wide and 37.75 inches long. Side portions 74 can also be fastened by any means available to hold mounting plate 70 securely to back wall 22 such as with rivets, but are preferably welded.

Figure 6:
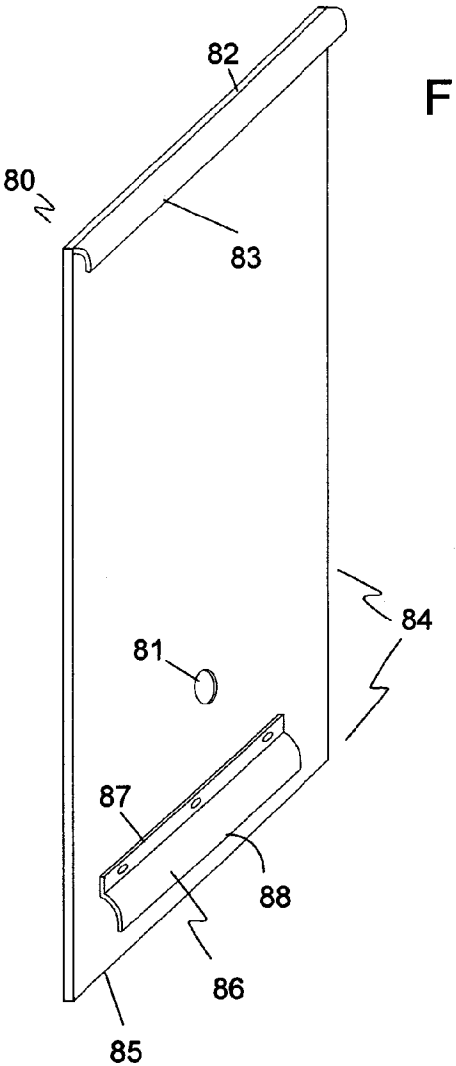
FIG. 6 is a perspective view of the chamber covers of the present invention showing the cover retaining members.

FIG. 6 is a perspective view of the inside of optional chamber covers 80. Chamber cover 80 has a top edge 82 and an inside bottom portion 84. Top edge 82 includes a top cover retaining member 83 that is curved back towards the center of chamber cover 80 and is configured to mate with cover holding member 131 of enclosure 20. Cover retaining member 83 can be formed by any suitable means. For example, cover retaining member 83 can be made by making another bend in top edge 82 of cover 80 which can be accomplished by starting with a longer sheet of material when forming cover 80. Preferably, however, it is a separate holding member 131 that is attached to cover 80 adjacent top edge 82 by any means known to one of ordinary skill in the art such as screws, rivets, spot welding, and the like.

Inside bottom portion 84 has a bottom cover retaining member 86 spaced from a bottom edge 85 of cover 80. Bottom cover retaining member 86 has a flat portion 87 and a curved portion 88 that is curved away from flat portion 87 and spaced from the plane defined by flat portion 87. Bottom cover retaining member 86 slidably secures cover 80 to lip 24*b* of bottom wall 40 of the enclosure 20. Preferably, bottom cover retaining member 86 is positioned on inside bottom portion 84 so that a portion of bottom edge 85 rests on lip 24*b* to support bottom edge 85 when installing cover 80 over chamber 92. Bottom cover retaining member 86 slidingly engages lip 24*b*. Cover 80 may also include optional opening 81 to facilitate installation and removal of cover 80. It should be understood that cover 80 may have any type of optional fixture such as a handle, slot, etc. to provide an easy means to slide cover 80 on or off of enclosure 20.

Figure 7:
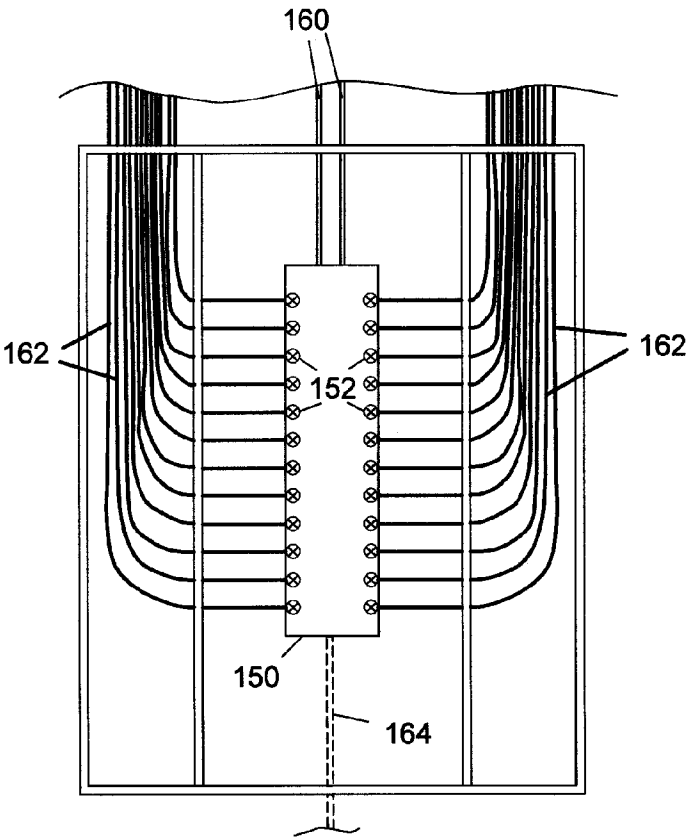
FIG. 7 is a front view of one embodiment of the present invention showing a manifold installed in the manifold cabinet.

FIG. 7 is a front view of one embodiment of the present invention showing a manifold used for hot and cold water installed in manifold cabinet 10. A manifold 150 is affixed to mounting plate 70 on back wall 22 of enclosure 20. Main hot and cold water supply lines 160 are attached to manifold 150 through center opening 36 on top wall 30. Output tubing 162 is connected to each output valve 152 through the plurality of openings 62 in partition walls 60 and routed up and out through outside edge openings 38 in top wall 30 of the enclosure 20. An optional drain tube 164 may be installed and connected to the bottom of manifold 150 at a special drain port (not shown) an out through drain opening 44 in bottom wall 40.

Figure 8:
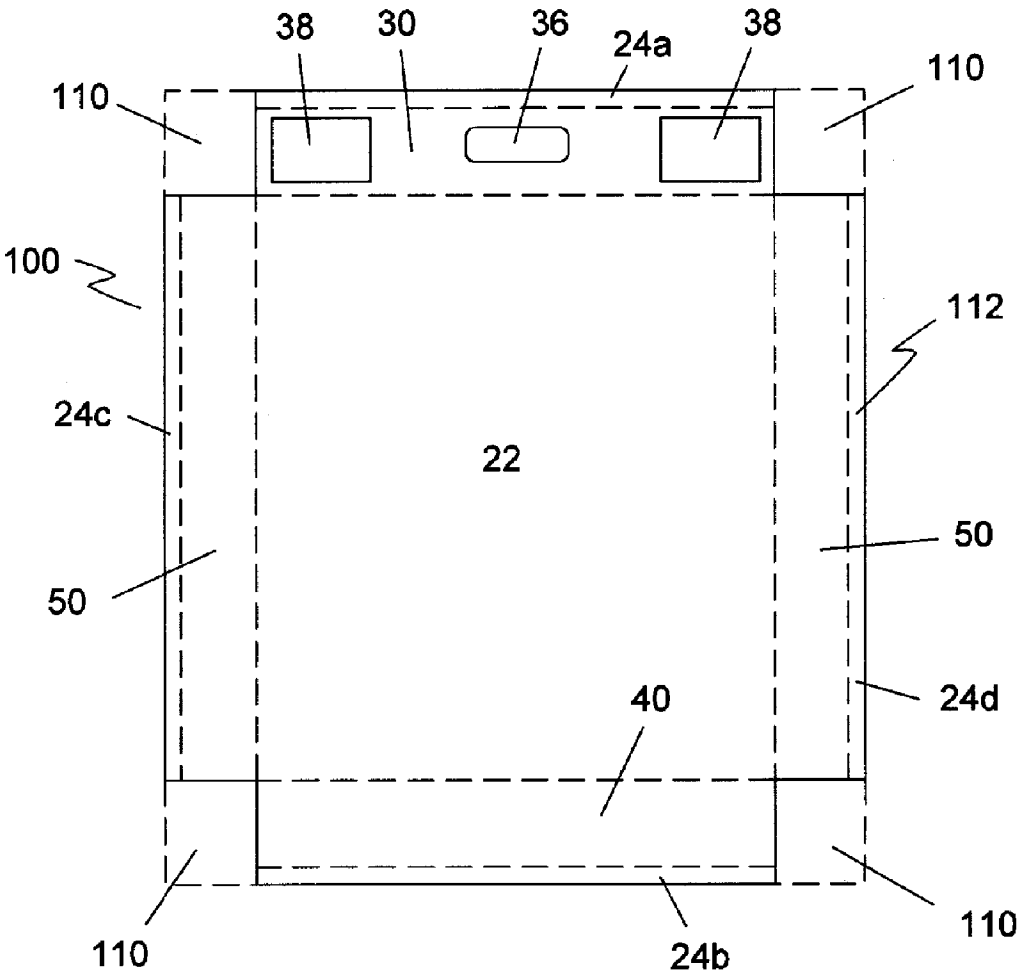
FIG. 8 is a plan view of one embodiment for forming the enclosure of the present invention.

FIG. 8 is a plan view of one embodiment for forming the enclosure of the present invention. Manifold cabinet 20 can be assembled a number of ways including assembling separate back, top, bottom, and side walls to each other by way of welding or other seam closure means, or casting the enclosure from a mold, etc., enclosure 20 is preferably made from a single piece of sheet metal since it is more economical. As shown in FIG. 8, a sheet 100 consisting of a rectangular piece of sheet metal is obtained. Corner portions 110 (as illustrated by the dotted lines) are removed from the sheet 100. Center opening 36 and side edge openings 38 are stamped, punched or otherwise cut into sheet metal 100. Lip 24 is formed by bending an outside edge portion 112 along the four shortened sides of sheet 100 to about a 90° angle. Once lip 24 is formed, then back wall 22, top wall 30, bottom wall 40, and side walls 50 are formed by performing another bend of about a 90° angle along the four shortened sides. The corners that are formed by the second bend are then secured preferably by welding.

After the plurality of openings 62 are formed in partition walls 60, partition walls 60 are installed in enclosure 20 to create central chamber 90 and side chambers 92. Partition walls 60 are secured to enclosure 20 by any means, but preferably by welding.

Where optional mounting plate 70 is used, it is installed against back wall 22. Optional mounting plate 70 is also preferably made of a rectangular piece of sheet metal and configured by bending the long sides to create stepped portion 72 and side portions 74. Mounting plate 70 is fastened to back wall 22 of enclosure 20 by any means, but preferably by welding.

Optional covers 80 are formed from a piece of rectangular piece of sheet metal. Top cover retaining member 83 and bottom cover retaining member 86 are secured to their respective positions on cover 80. An opening 81 is preferably formed such as by drilling, cutting, stamping, or punching into cover 80 spaced from bottom edge 85. As explained previously, top cover retaining member 83 and bottom cover retaining member 86 may be formed by a series of bends or cuts and bends along the top and bottom edges 82, 85, respectively.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A manifold cabinet for a manifold comprising:

an enclosure having a back wall, a top wall, a bottom wall, and a pair of side walls;

at least two partition walls, each having a plurality of openings, said partition walls attached within said enclosure forming a larger central chamber sized to receive a manifold and two side chambers; and a center opening and at least two outside edge openings wherein said center opening provides access to said larger central chamber and wherein one of said at least two outside edge openings provides access to one of said two side chambers and another of said at least two outside edge openings provides access to the other of said two side chambers.

2. The manifold cabinet of claim 1 wherein said center opening and said at least two outside edge opening are formed in one of said top wall, said bottom wall or both.

3. The manifold cabinet of claim 1 further comprising a manifold mounting plate attached to said back wall.

4. The manifold cabinet of claim 1 wherein said enclosure has a lip formed along an outside perimeter.

5. The manifold cabinet of claim 1 further comprising a cover holding member along a front edge of said top wall and positioned to align with one of said two side chambers.

6. The manifold cabinet of claim 1 further comprising a cover sized to cover one of said two side chambers.

7. The manifold cabinet of claim 6 wherein said cover is slidingly engageable with said enclosure.

8. The manifold cabinet of claim 7 wherein said cover includes a top cover retaining member formed at a top edge of said cover.

9. The manifold cabinet of claim 7 wherein said cover includes a bottom cover retaining member formed on a bottom portion of said cover and spaced from a bottom edge of said cover.

10. The manifold cabinet of claim 1 wherein said two side chambers are substantially of equal size.

* * * * *